United States Patent [19]

Kihara

[11] 4,129,084

[45] Dec. 12, 1978

[54] NEEDLE BAR DISENGAGING DEVICE FOR SEWING MACHINES

[75] Inventor: Yoshio Kihara, Sakai, Japan

[73] Assignee: Sanwa Industries, Ltd., Osaka, Japan

[21] Appl. No.: 784,141

[22] Filed: Apr. 4, 1977

[30] Foreign Application Priority Data

Apr. 12, 1976 [JP] Japan ..... 51-40720
Sep. 29, 1976 [JP] Japan ..... 51-131083[U]

[51] Int. Cl.[2] ..... D05B 55/16
[52] U.S. Cl. ..... 112/221
[58] Field of Search ..... 112/221, 220, 270

[56] References Cited

U.S. PATENT DOCUMENTS

| | | | |
|---|---|---|---|
| 1,048,203 | 12/1912 | Oliver | 112/221 |
| 3,460,499 | 8/1969 | Gaines | 112/221 |
| 3,815,529 | 6/1974 | Adams et al. | 112/221 X |
| 3,872,809 | 3/1975 | Adams et al. | 112/221 |

*Primary Examiner*—Peter Nerbun

*Attorney, Agent, or Firm*—Brooks, Haidt, Haffner & Delahunty

[57] ABSTRACT

The mechanism for driving a sewing machine needle bar and the needle carried thereby in reciprocating motion continues to operate without interruption while the needle bar is selectively disengaged from the driving mechanism to skip stitches. A spring biased latch mechanism has a spring mounted within the needle bar and a catch finger that can be extended from and withdrawn within a slot in the needle bar. A spring under tension urges the needle bar towards its upper position where the needle is out of contact with the work. In one embodiment the spring is attached at one end to the sewing machine frame, and in another embodiment the spring is attached to part of the latch release member. Two forms of latch release member are disclosed, one having a generally straight contact surface for causing retraction of the catch finger, the other form having a slanted contact surface.

17 Claims, 5 Drawing Figures

NEEDLE BAR DISENGAGING DEVICE FOR SEWING MACHINES

BACKGROUND OF THE INVENTION

1. Field of the Invention

The invention relates to sewing machines, and more particularly to a selective disengagement arrangement for the needle bar of a sewing machine.

2. Description of the Prior Art

Sewing machines presently available include a needle bar which carries the needle and a mechanism for driving the needle bar in endwise reciprocating movement. In some prior art sewing machines, a releasable latch for selectively connecting and disconnecting the needle bar from its driving mechanism has been provided so that the machine can skip stitches upon disengagement of the needle bar, either automatically, or upon operator control. As examples of disengaging devices, the mechanisms of the following U.S. patents can be considered: Adams et al. U.S. Pat. Nos. 3,782,311 and 3,815,529 and 3,872,809; Gaines U.S. Pat. No. 3,460,499 and Cobble et al. U.S. Pat. No. 2,318,200. There are various other prior art disengagement devices, but those listed are believed to be illustrative. These devices of the prior art generally have latch mechanisms external to the needle bar itself, and consideration appears not to have been given to fitting latch elements internally in a tubular needle bar.

SUMMARY OF THE INVENTION

The sewing machine needle bar disengagement device of the present invention includes latching parts mounted within a tubular needle bar and spring biased to project outward of the needle bar for selective engagement with means for driving the needle bar in the reciprocating movement that makes stitches in the work when the latch is engaged. Selectively movable means for depressing the latch projection inwardly disengages the needle bar from the driving mechanism. A spring under tension urges the needle bar to an upper position when the latch is disengaged, and a buffer spring is preferably provided to prevent jarring motion.

The hollow tubular needle bar is slidably fitted in axially aligned bores of spaced arms of a driving frame for reciprocating endwise motion under the driving force of a known driving mechanism transmitted to the needle bar through a collar selectively latched to the needle bar between the driving frame arms. A guide pin on the needle bar travels in a generally vertical guide slot of a needle bar guide plate from a lower needle bar position at which the needle deployed in stitching to an upper retracted skip stitch position to which the needle bar is spring biased when disengaged from the driving mechanism.

A release plate element is movable toward and away from the needle bar to contact a part of the latch projecting through a slit in the needle bar. Depression of the latch inwardly by engagement of the release plate disengages the needle bar from its surrounding collar which slides freely upon the needle bar while the driving mechanism continues to operate with the needle bar disengaged.

When the latch mechanism is disengaged the work can continue to move beneath the raised needle, skipping stitches for the space desired and then the latch can be engaged to start stitching again.

The disengagement action is rapid and reliable despite the relative simplicity and low cost of the mechanism. These and other features and advantages of the invention will be more fully understood from the following detailed description of preferred embodiments of the invention, especially when that description is read with reference to the accompanying drawing figures.

BRIEF DESCRIPTION OF THE DRAWINGS

In the drawings, in which like reference numerals indicate like parts throughout.

DETAILED DESCRIPTION OF PREFERRED EMBODIMENTS

The accompanying drawings do not show the complete structure of a sewing machine, since the needle bar disengaging device of the invention is intended to be adapted for use in any of various conventional sewing machines of the type having a mechanism for driving a needle up and down in reciprocating motion. Those who are acquainted with sewing machine construction will understand how the device of the present invention is to be employed in sewing machines of various kinds, whether manual or automatic and including modern electronically controlled machines.

Figure 1:
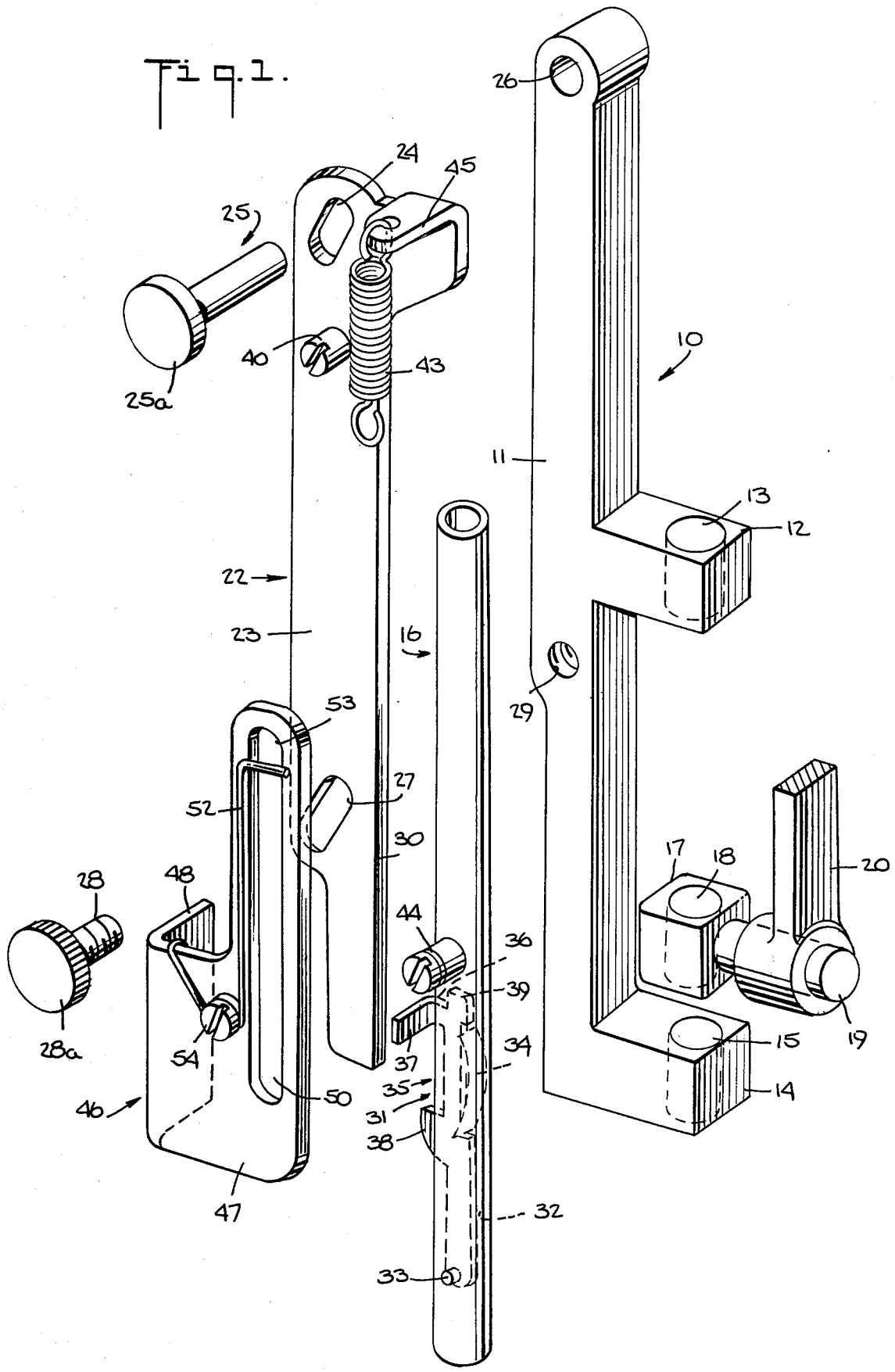
FIG. 1 is an exploded isometric view of one preferred embodiment of needle bar disengaging device of the invention.

In FIG. 1, the needle bar driving frame generally designated 10 has an elongated, generally vertically oriented body 11. An upper frame arm 12 having a vertical bore hole 13 and a lower arm 14 having a bore hole 15 aligned with the hole 13 extend generally perpendicularly rearward from the driving frame body 11 near the mid-portion and the lower end of the body 11 respectively. The bore holes 13 and 15 are sized to receive closely yet slidably a tubular needle bar generally designated by reference numeral 16 for reciprocating motion of the needle bar 16 with respect to the driving frame 10.

The needle bar 16 carries a conventional sewing needle at its lower end (not shown in the drawing), the bar 16 moving the needle up and down through work to be sewn. It should be noted that the terms vertical and horizontal, up and down are used throughout this specification to describe relative positions of parts and directions of motion only, since in actual practice the needle bar 16 and other cooperating parts may be mounted at some angle with respect to vertical, as in some kinds of sewing machines wherein a needle contacts the work at an angle.

For driving the needle bar 16 (and the needle carried thereby) in endwise reciprocating motion, a collar generally designated by reference numeral 17, and having a central cylindrical aperture 18 encompasses the needle bar 16 between the upper and lower arms 12 and 14. A pivot connector 19 couples the collar 17 with the driving mechanism of the sewing machine, illustrated only by the crank arm 20, since any of various kinds of driving mechanism producing a suitable reciprocating motion can be employed. When the needle bar 16 is engaged with the collar 17 by means to be described more fully hereafter the needle bar 16 moves in endwise reciprocating motion with the collar 17, and upon disengagement in accordance with the invention the collar 17 is free to move up and down with respect to the needle bar 16 while the needle bar 16 remains stationary.

Figures 2, 3, 4, 5:
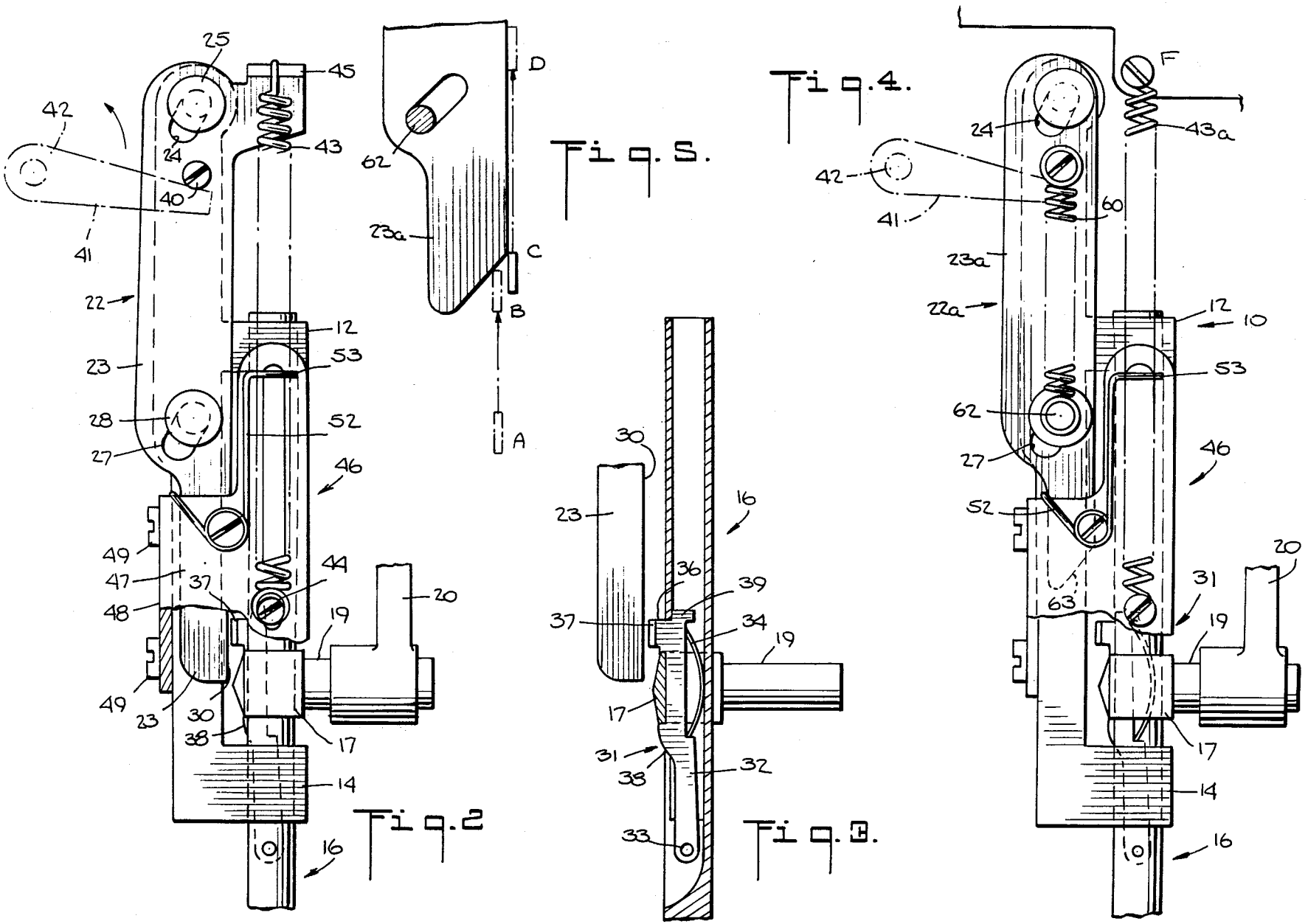
FIG. 2 is a side view of the device of FIG. 1, with some parts broken away, ans some internal parts shown in dashed lines.
FIG. 3 is a side view in detail of the latch mechanism of the device of FIGS. 1 and 2.
FIG. 4 is a view similar to that of FIG. 2 showing another embodiment of the needle bar disengaging device of the invention.
FIG. 5 is an enlarged detail view of a modified latch release means shown in FIG. 4.

The structural elements already described are shown in FIG. 2 in assembled relationship with each other and with a needle bar release assembly generally designated 22 which comprises an elongated plate-like body 23 extending generally vertically. The plate-like body 23 has a slanted slot 24 near its upper end for sliding reception of a pin 25 passing through the slot 24 and secured to frame elements of the sewing machine (not shown) after passage through a horizontal bore hole 26 at the upper end of the driving frame 10. A second slanted slot 27 passes through the plate-like body 23 at a lower part thereof for sliding reception of a screw 28 attached to the driving frame 10 by threaded fit in a bore hole 29 located below the upper driving frame arm 12. The pin 25 has an enlarged head **25*a* and the screw 28 has enlarged head 28*a* to retain the plate-like body 23 generally parallel with the driving frame body 11 and needle bar 16. The slots 24 and 27 are slanted at similar angles with respect to the body 23 so that the body 23 can slide inwardly and upwardly or downwardly and outwardly with respect to the driving frame 10 on the attachment elements 25 and 28, to approach or withdraw from the needle bar 16. The plate-like body 23 in FIG. 1 is shown to have a front surface 30** for contacting and disengaging latch structure to be described in greater detail hereafter.

Dashed lines in FIG. 1 show parts of a latch mechanism 31 housed within the tubular needle bar 16, which mechanism can be more fully understood by comparing FIG. 1 with FIGS. 2 and 3 of the drawings. The latch 31 has an upwardly extending elongated body 32, pivotable about a mounting pin 33 that is secured transversely of the needle bar. The body 32 is biased by a compression spring member 34 shown as a plate spring which urges the body to pivot about the pin 33 toward a longitudinal slot 35 in the needle bar 16. On its side facing the slot 35 the latch body 32 has an arm 36 extending out of the slot 35 and terminating in a finger 37 bent at a right angle to the arm 36 which prevents complete retraction of the body 32. Spaced below the arm 36 and finger 37 is a stepped projection 38 of the body 32 which extends outwardly of the needle bar 16 to a lesser extent than the arm 36 when the latch is engaged with the collar 17 as shown in FIGS. 2 and 3. The upper end portion 39 of the latch body 32 extends above the top of the slot 35 to stop the pivotal movement of the latch beyond the desired extension of the arm 36 and stepped projection 38. It will thus be seen that in the normal engaged condition, the collar 17 on the driving mechanism is engaged by the latch 31 between the arm 36 and stepped projection 38 holding the needle bar 16 in secure driving engagement for reciprocating motion.

The latch 31 is disengaged by pressure of the engagement surface 30 of the plate-like body 23 of the needle bar release assembly 22 against the finger 37. Pushing the finger 37 and, accordingly the latch body 32 and stepped projection 38 inward, the engagement surface 30 releases the latch 31 and allows the collar 17 to move freely down and up with respect to the needle bar 16. To move the plate-like body 23 and its engagement surface 30 toward the disengagement condition, the plate-like body 23 must travel inward and upward guided by the slots 24 and 27 therein. Means for producing this inward and upward movement are shown in FIG. 2 as a pin 40 extending perpendicularly from one side of the plate-like release body 23 and a crank arm 41 pivotable about a pivot pin 42 secured to the sewing machine frame. The latter parts are shown in dashed lines to emphasize that some other kind of mechanical linkage could be employed to move the plate-like body 23 toward the latch release position.

When the latch 31 is released, as indicated, the collar 17 moves freely with respect to the needle bar 16, ending reciprocating motion of the needle bar 16 and the needle carried thereby, but the needle should also be retracted upwardly away from the work in this disengaged condition so that the work can move freely and to avoid interference between the collar 17 and the latch components such as the finger 37. In the embodiment of FIGS. 1 and 2, this upward retraction of the needle bar 16 is produced by a coil spring 43 extending from a pin 44 that projects from the needle bar 16 to an arm 45 which extends outward from the plate-like body 23 of the latch release mechanism 22.

It will be seen that inward and upward latch releasing movement of the body 23 in the embodiment of FIGS. 1 and 2 serves to increase tension in the spring 41 tending to draw the needle bar 16 upward upon disengagement of the latch 31.

A guide device generally designated 46 is provided to guide and control motion of the needle bar 16 both during sewing and upon disengagement. The guide device 46 comprises a plate 47 shown as having a flange 48 bent at a right angle to the plate 47 for attachment to the driving frame 10 by fasteners such as the screws 49 shown in FIG. 2.

The guide plate 47 has a vertically extending guide slot 50 through which the pin 44 of the needle bar 16 extends as shown in FIG. 2. The pin 44 moves up and down in the slot 50 as the needle bar 16 moves in endwise reciprocation, and upon disengagement of the latch 31, the pin 44 is pulled further upward along slot 50 than in sewing operation by the spring 43 secured to the pin 44. It will be seen that the pin 44 and arm 45 are of sufficient length so that the spring 43 is free of interference with other parts.

A buffer spring 52 has a portion 53 extending across the path of the pin 44 near the top of the guide slot 50 to resiliently restrain the pin 44 from excess upward movement upon disengagement of the latch 31. As shown in FIGS. 1 and 2, the buffer spring is secured to the guide plate 47 by a screw 54, allowing some adjustability.

The extent of upward travel of the needle bar 16 under the influence of the retraction spring 43 is limited, so that every time the collar 17 reaches the uppermost point of its reciprocating movement, the collar 17 is in position for engagement by the latch 31. However, the latch 31 cannot lock into engagement so long as the finger 37 stays depressed by the engagement surface 30. Upon release of the finger 37 by the downward and outward movement of the plate-like body 23, the latch is ready to engage the collar 17 on its next arrival at the top of its reciprocating motion, and sewing of stitches begins again. Downward pivoting of the crank lever 41 moves the plate-like body 23 into position for latch engagement.

In the embodiment of the invention shown in FIG. 4, parts having reference numerals corresponding to parts in FIGS. 1–3 are similar thereto in structure and function. Thus the needle bar 16, latch mechanism 31 and guide device 46, among other parts, correspond to those already described. However, there are certain differences between the embodiment of FIG. 4 and that of the embodiment in the figures already discussed. The modification incorporated in the embodiment of FIG. 4 are primarily advantageous in compensating for time lags to avoid defect in stitching and tangling of thread or the like when the needle bar 16 rises upon disengagement of the latch mechanism 31.

A first difference between the embodiment of FIG. 4 and that of FIGS. 1 to 3 is that the coil spring 43*a* of FIG. 4 for retracting the needle bar 16 is not secured to any part of the needle bar release assembly 22*a* of FIG. 4, but is instead secured to the sewing machine's frame structure, indicated at F. The release assembly 22*a* of FIG. 4 has no structure corresponding to the arm 45. A further difference between the embodiment of FIG. 4 and that of FIGS. 1–3 is the addition of restoring spring 60. The upper end of the spring 60 is secured to a pin 61 which serves not only as a mounting for the spring 60, but also as an abutment for the latch release lever 41. The lower end of the restoring spring 60 is secured to a screw 62 which not only serves as a mounting for the spring 60, but also replaces the guide pin 28 of the previously discussed embodiment. The screw 62 passes through inclined guide slot 27 and is secured to the needle bar driving frame 10. Tension in the restoring spring 60 tends to pull the release mechanism 22*a* away from contact with the latch mechanism 31 (i.e. downward and to the left in FIG. 4). Thus the spring 60 urges the latch release mechanism 22*a* away from its latch releasing position. Movement of the release lever 41 clockwise from the position of FIG. 4 results in spring actuated motion of the latch release mechanism 22*a* as indicated.

A further difference between the embodiment of FIG. 4 and that of FIGS. 1–3 is that instead of a straight, generally vertical contact surface like the surface 30 of FIGS. 1–3, the plate-like body 23*a* of FIG. 4 has an inclined cam surface 63 at its lower end for more accurate control of the timing of contact and latch disengagement under pressure from the plate-like body 23*a* as shown in the detail view of FIG. 5.

The operation of the additional elements and modifications shown in FIGS. 4 and 5 is to prevent premature upward motion of the needle bar 16, which might otherwise occur while the needle bar 16 is near the bottom of its stroke while a needle is still incompletely withdrawn from the cloth or other work. The movement of the latch finger 37 as the needle bar 16 rises is schematically shown in FIG. 5. Should the release lever 41 be moved counterclockwise to release the needle bar 16 from driving engagement while the needle bar 16 is near the bottom of its reciprocating cycle, as when the latch finger 37 is at the position A in FIG. 5, the relative motion of the latch arm 37 takes the arm 37 into sliding contact with the camming surface 63 at point B in FIG. 5 whereupon the latch 31 begins to move toward release through the position C of FIG. 5. Retraction of the needle bar proceeds from points C to D only after this gradual engagement. By adjustment of the relative positions of the parts defects in sewing due to untimely release and retraction of the needle bar 16 are prevented.

The needle of the needle bar 16 in the embodiment of FIGS. 4 and 5 cannot be jerked upward upon actuation of the release lever 41 in the embodiment of FIGS. 4 and 5 but can only move rapidly upward under the force of the spring 43*a* after the latch 31 has been released at a position where the stitching is no longer in danger of damage by rapid retraction of the needle. Normal sewing motion is uninterrupted until a time when withdrawal of the needle can do no damage.

It will be seen that the camming surface 63 of the embodiment of FIG. 4 is complemented by interaction with the employment of the restoring spring 60.

It should be realized that instead of using a tubular needle bar like the needle bar 16, a needle bar having a longitudinal groove could house the latch mechanism 31.

Numerous other modifications, uses and adaptations of the device described will suggest themselves to those familiar with the art and are considered to be within the spirit and scope of the invention.

What is claimed is:

1. In a sewing machine having a frame, a needle bar mounted for endwise reciprocating motion in said frame, a driving mechanism for effecting endwise reciprocation of said needle bar, a latch mechanism for selectively connecting and disconnecting said driving mechanism with and from said needle bar, and a latch release member supported on said frame for movement alternately into and out of a position for releasing said latch mechanism, the improvement wherein said needle bar has a recess therein extending in the direction of the extending transversely to the direction of endwise reciprocation of said needle, and wherein said latch mechanism has a latch element mounted in said recess for movement in said recess from a first position in which it extends outwardly of said needle bar and connects said needle bar to said driving mechanism to a second position disposed in a direction inwardly of said needle bar with respect to said first position in which it disconnects said needle bar from said driving mechanism.

2. The combination as set forth in claim 1, wherein said latch element is pivotally mounted in said recess and further comprising spring means in said recess urging said element into said first position.

3. The combination as set forth in claim 1, wherein said latch release member has a surface which is engageable with a portion of said latch element when said member is in said position thereof.

4. The combination as set forth in claim 3, wherein said surface of said latch release member extends at an acute angle with respect to the direction of reciprocation of said needle bar and so that the portion of said surface nearest said needle bar is farther from said portion of said latch element than the remainder of said surface.

5. The combination as set forth in claim 3, further comprising spring means connected between said latch release member and said needle bar and urging said needle bar in the endwise direction thereof and with respect to said driving means whereby said needle bar moves relative to said driving means when said latch element is moved into said second position thereof.

6. The combination as set forth in claim 3, further comprising spring means connected between said frame and said needle bar and urging said needle bar in the endwise direction thereof and with respect to said driving means whereby said needle bar moves relative to said driving means when said latch element is moved into said second position thereof.

7. The combination as set forth in claim 6, further comprising further spring means connected between said frame and said latch release member and urging said member out of said position thereof.

8. The combination as set forth in claim 1, further comprising spring means mounted on said frame and means on said needle bar engageable with said last-mentioned spring means when said needle bar is disconnected from said driving mechanism for limiting endwise movement of said needle bar.

9. In a sewing machine having a frame, a needle bar mounted for endwise reciprocating motion in said frame, a driving mechanism for effecting endwise reciprocation of said needle bar, a latch mechanism for selectively connecting and disconnecting said driving mechanism with and from said needle bar, and a latch release member supported on said frame for movement alternately into and out of a position for releasing said latch mechanism, the improvement comprising spring means having an upper end connected to said frame and a lower end connected directly to said needle bar and urging said needle bar in the endwise direction thereof and with respect to said driving means and said latch release member whereby said needle bar moves relative to said driving means and said latch release member when said latch member is moved into said position thereof for releasing said latch mechanism, further spring means mounted on said frame and means on said needle bar engageable with said last-mentioned spring means when said needle bar is disconnected from said driving mechanism for limiting endwise movement of said needle bar.

10. The combination as set forth in claim 9, further comprising further spring means connected between said frame and said latch release member and urging said member out of said position thereof.

11. In a sewing machine having a frame, a needle bar mounted for endwise reciprocating motion in said frame, a driving mechanism for effecting endwise reciprocation of said needle bar, a latch mechanism for selectively connecting and disconnecting said driving mechanism with and from said needle bar, and a latch release member supported on said frame for movement alternately into and out of a position for releasing said latch mechanism, the improvement comprising spring means having an upper end connected to said frame and a lower end connected directly to said needle bar and urging said needle bar in the endwise direction thereof and with respect to said driving means and said latch release member whereby said needle bar moves relative to said driving means and said latch release member when said latch member is moved into said position thereof for releasing said latch mechanism and wherein said needle bar has a recess therein and said latch mechanism has a latch element mounted in said recess for movement in said recess from a first position in which it extends outwardly of said needle bar and connects said needle bar to said driving mechanism to a second position disposed in a direction inwardly of said needle bar with respect to said first position in which it disconnects said needle bar from said driving mechanism, said latch element being pivotally mounted in said recess and further comprising spring means in said recess urging said element into said first position.

12. The combination as set forth in claim 11, wherein said latch release member has a surface which is engageable with a portion of said latch element when said member is in said position thereof, said surface of said latch release member extending at an acute angle with respect to the direction of reciprocation of said needle bar and so that the portion of said surface nearest said needle bar is farther from said portion of said latch element than the remainder of said surface.

13. In a sewing machine having a frame, a needle bar mounted for endwise reciprocating motion in said frame, a driving mechanism for effecting endwise reciprocation of said needle bar, a latch mechanism for selectively connecting and disconnecting said driving mechanism with and from said needle bar, and a latch release member supported on said frame for movement alternately into and out of a position for releasing said latch mechanism, the improvement wherein said latch mechanism has a latch element pivotally mounted in a recess in said needle bar and said latch release member has a surface which is engageable with a portion of said pivotally mounted latch element when said member is in said position thereof for releasing said latch mechanism.

14. The combination as set forth in claim 13, wherein said recess in the needle bar extends in the direction of and extends transversely to the direction of endwise reciprocation of said needle bar, and wherein said latch element is pivotally mounted in said recess for movement in said recess from a first position in which it extends outwardly of said needle bar and connects said needle bar to said driving mechanism to a second position disposed in a direction inwardly of said needle bar with respect to said first position in which it disconnects said needle bar from said driving mechanism.

15. The combination as set forth in claim 14, further comprising spring means connected between said frame and said needle bar and urging said needle bar in the endwise direction thereof and with respect to said driving means whereby said needle bar moves relative to said driving means when said latch element is moved into said second position thereof.

16. The combination as set forth in claim 15, further comprising further spring means connected between said frame and said latch release member and urging said member out of said position thereof.

17. The combination as set forth in claim 16, further comprising spring means mounted on said frame and means on said needle bar engageable with said last-mentioned spring means when said needle bar is disconnected from said driving mechanism for limiting endwise movement of said needle bar.

* * * * *